US008485953B2

(12) United States Patent
Chou

(10) Patent No.: US 8,485,953 B2
(45) Date of Patent: Jul. 16, 2013

(54) EXERCISER

(75) Inventor: Yu-Chih Chou, Xiamen (CN)

(73) Assignee: Xiamen Zhoulong Sporting Goods Co., Ltd., Xiamen, Fujian Province (CN)

( * ) Notice: Subject to any disclaimer, the term of this patent is extended or adjusted under 35 U.S.C. 154(b) by 219 days.

(21) Appl. No.: 13/103,373

(22) Filed: May 9, 2011

(65) Prior Publication Data

US 2011/0275496 A1 Nov. 10, 2011

(30) Foreign Application Priority Data

May 10, 2010 (CN) ..... 2010 2 0193907 U

(51) Int. Cl.
*A63B 21/00* (2006.01)

(52) U.S. Cl.
USPC ..... 482/131

(58) Field of Classification Search
USPC ..... 482/95, 96, 131, 140, 79, 80, 92, 482/121, 122, 125, 129, 139, 142, 145
See application file for complete search history.

(56) References Cited

U.S. PATENT DOCUMENTS

| | | | | | |
|---|---|---|---|---|---|
| 4,231,568 | A * | 11/1980 | Riley et al. | ..... | 482/130 |
| 4,844,454 | A * | 7/1989 | Rogers | ..... | 482/131 |
| 5,195,937 | A * | 3/1993 | Engel et al. | ..... | 482/119 |
| 5,674,167 | A * | 10/1997 | Piaget et al. | ..... | 482/130 |
| 5,716,308 | A * | 2/1998 | Lee | ..... | 482/130 |
| 5,733,229 | A * | 3/1998 | Dalebout et al. | ..... | 482/96 |
| 5,779,606 | A * | 7/1998 | Chen | ..... | 482/130 |
| 7,250,022 | B2 * | 7/2007 | Dalebout et al. | ..... | 482/142 |
| 7,815,552 | B2 * | 10/2010 | Dibble et al. | ..... | 482/92 |
| 2007/0225135 | A1 * | 9/2007 | Webber | ..... | 482/140 |
| 2011/0152045 | A1 * | 6/2011 | Horne | ..... | 482/131 |
| 2011/0319237 | A1 * | 12/2011 | Jones et al. | ..... | 482/140 |

* cited by examiner

*Primary Examiner* — Loan Thanh
*Assistant Examiner* — Nyca T Nguyen

(57) ABSTRACT

An exerciser includes a board, a frame, a swing rod, an upper foot rest, a lower foot rest and a resilient rope. An upper end of the swing rod is articulated to an upper end of the vertical support and a lower end of the swing rod is fixed to a central portion of the lower foot rest. The resilient rope is connected between the swing rod and the vertical support. The board is fixed on the lengthwise beam of the frame. The lengthwise beam and the vertical support of the present invention form a triangular support. The board installed on the lengthwise beam is arranged obliquely.

1 Claim, 5 Drawing Sheets

EXERCISER

BACKGROUND OF THE INVENTION

1. Field of the Invention

The present invention relates to an exerciser, and more particularly to an exerciser for doing sit-ups and press-ups.

2. Description of the Prior Art

Nowadays, exercisers are widely used because people pay much attention to health and the living standard is gradually rising. People desire to have an exerciser having multiple functions, such as physical therapy, massage, body-building. In particular, an exerciser can do exercise for each part of the body.

SUMMARY OF THE INVENTION

The primary object of the present invention is to provide an exerciser which has a simple structure and multiple functions.

In order to achieve the aforesaid object, there is provided an exerciser which comprises a board, a frame, a swing rod, an upper foot rest, a lower foot rest and a resilient rope. The frame comprises a lengthwise beam, a vertical support, a front bottom bracket and a rear bottom bracket. A front end of the lengthwise beam is perpendicularly fixed to a central portion of the vertical support and a rear end of the lengthwise beam is perpendicularly fixed to a central portion of the rear bottom bracket. An upper end of the vertical support is fixed to a central portion of the upper foot rest and a lower end of the vertical support is fixed to a central portion of the front bottom bracket. The lengthwise beam and the vertical support form a triangular support. An upper end of the swing rod is articulated to an upper end of the vertical support and a lower end of the swing rod is fixed to a central portion of the lower foot rest. The resilient rope is connected between the swing rod and the vertical support. The board is fixed on the lengthwise beam of the frame.

Preferably, an inner end of the resilient rope is fixed to a lower portion of the vertical support, a central portion of the resilient rope winds through a first pulley on an upper portion of the vertical support, a second pulley on the lower portion of the vertical support and a third pulley on the lower end of the swing rod, and an outer end of the resilient rope is connected to a central portion of the swing rod.

Preferably, the swing rod has a plurality of slots thereon, the resilient rope has a hook at an outer end thereof, and the hook is connected to one of the slots of the swing rod.

Preferably, the upper portion of the vertical support has a pin hole for insertion of a pin.

Preferably, the upper end of the swing rod has a pin hole for insertion of a pin.

Preferably, the frame further comprises an armrest pipe and the armrest pipe is transversely connected to the lengthwise beam.

The lengthwise beam and the vertical support of the present invention form a triangular support. The board installed on the lengthwise beam is arranged obliquely. When the pin is inserted in the pin holes of the upper portion of the vertical support and the upper end of the swing rod, the swing rod won't swing relative to the vertical support of the frame for doing sit-ups. When the pin is pulled out from the pin holes of the upper portion of the vertical support and the upper end of the swing rod, the swing rod will swing relative to the vertical support of the frame. The resilient rope provides a damping force for doing exercise to get stronger leg muscles. The present invention has a simple structure and multiple functions.

DETAILED DESCRIPTION OF THE PREFERRED EMBODIMENTS

Embodiments of the present invention will now be described, by way of example only, with reference to the accompanying drawings.

Figure 1:
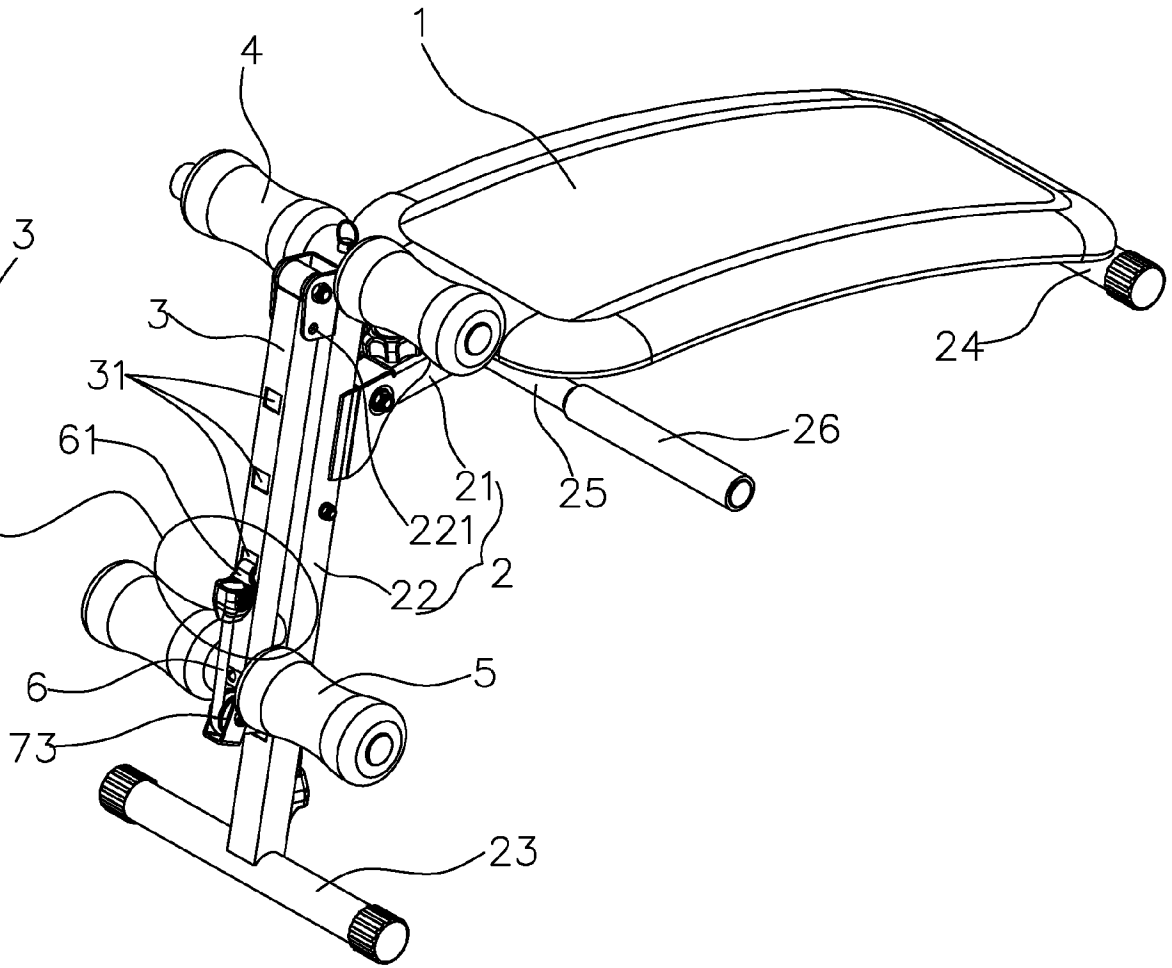
FIG. 1 is a perspective view according to a preferred embodiment of the present invention.
Figure 3:
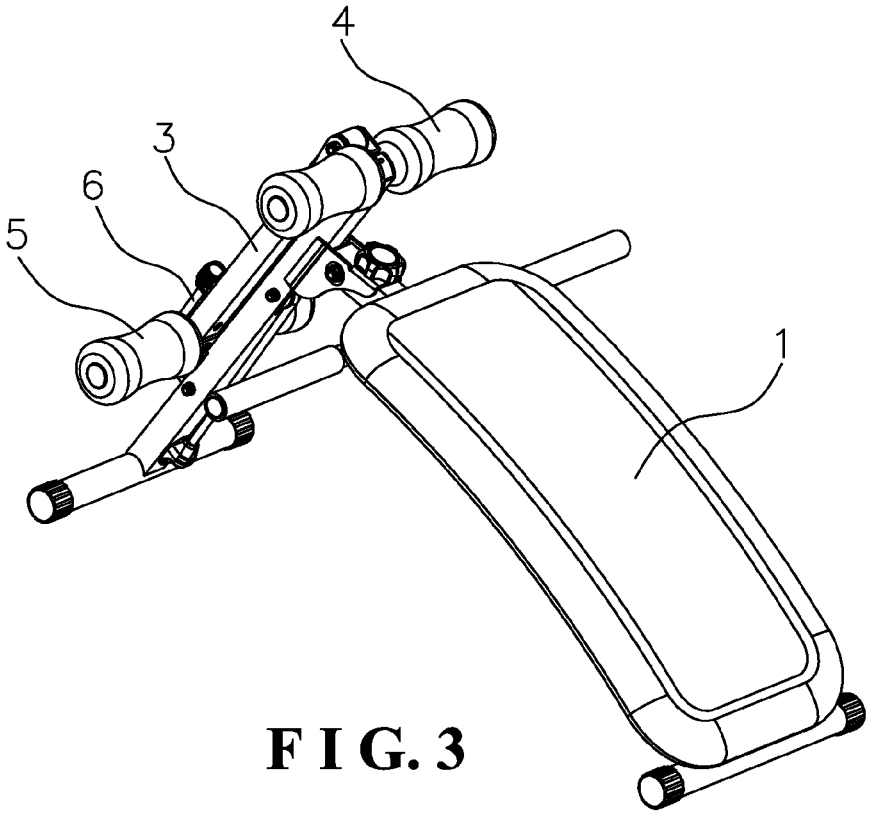
FIG. 3 is a perspective view showing the swing rod in a retracted state according to the preferred embodiment of the present invention.

As shown in FIGS. 1 and FIG. 3, an exerciser according to a preferred embodiment of the present invention comprises a board 1, a frame 2, a swing rod 3, an upper foot rest 4, a lower foot rest 5, and a resilient rope 6.

The frame 2 comprises a lengthwise beam 21, a vertical support 22, a front bottom bracket 23, a rear bottom bracket 24, and an armrest pipe 25. A front end of the lengthwise beam 21 is perpendicularly fixed to a central portion of the vertical support 22, and a rear end of the lengthwise beam 21 is perpendicularly fixed to a central portion of the rear bottom bracket 24. An upper end of the vertical support 22 is fixed to a central portion of the upper foot rest 4, and a lower end of the vertical support 22 is fixed to a central portion of the front bottom bracket 23. The lengthwise beam 21 and the vertical support 22 form a triangular support. The armrest pipe 25 is transversely connected to the lengthwise beam 21. The board 1 is fixed on the lengthwise beam 21 of the frame 2.

An upper end of the swing rod 3 is articulated to an upper end of the vertical support 22, and a lower end of the swing rod 3 is fixed to a central portion of the lower foot rest 5.

Figure 1A:
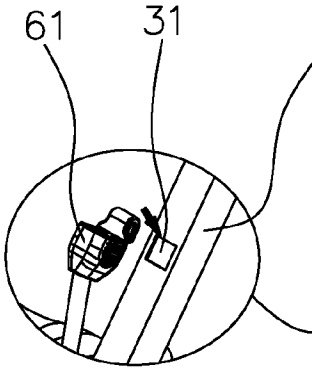
FIG. 1A is an enlarged view showing the hook and the slots of the swing rod according to the preferred embodiment of the present invention.
Figure 2:
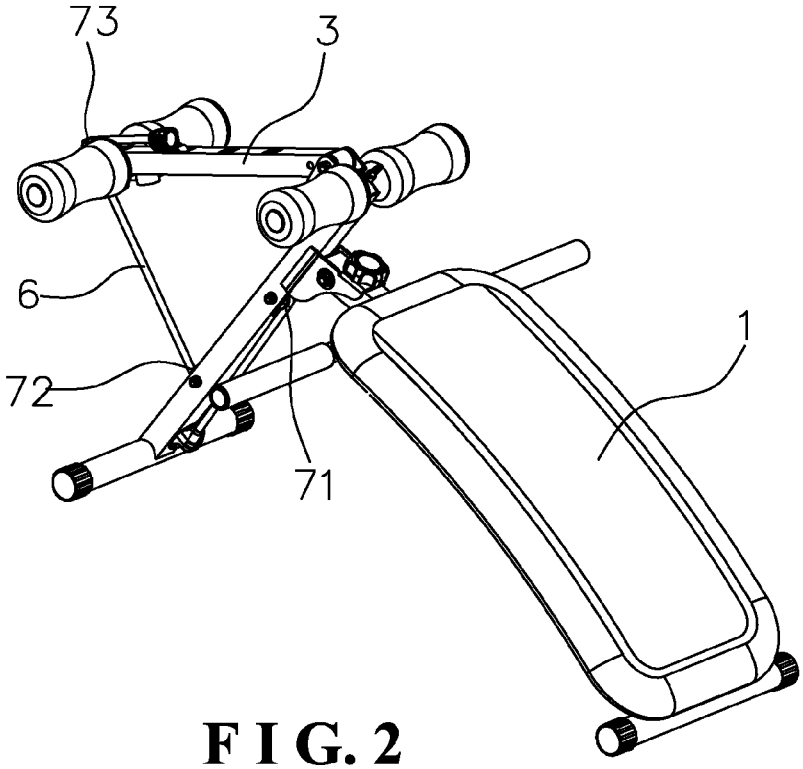
FIG. 2 is a perspective view showing the swing rod in an expanded state according to the preferred embodiment of the present invention.

As shown in FIG. 1 and FIG. 2, the swing rod 3 has a plurality of slots 31 thereron. The resilient rope 6 has a hook 61 at an outer end thereof. The hook 61 is connected to one of the slots 31 of the swing rod 3. In this embodiment, an inner end of the resilient rope 6 is fixed to a lower portion of the vertical support 22, and a central portion of the resilient rope 6 winds through a first pulley 71 on an upper portion of the vertical support 22, a second pulley 72 on the lower portion of the vertical support 22 and a third pulley 73 on the lower end of the swing rod 3. After that, the hook 61 at the outer end of the resilient rope 6 is engaged in one of the slots 31, as shown in FIG. 1A.

As shown in FIG. 1, the upper portion of the vertical support 22 has a pin hole 221 and the upper end of the swing rod 3 has an insertion hole 32 for insertion of a pin 8, such that the upper portion of the vertical support 22 and the upper end of the swing rod 3 are connected.

Figure 7:
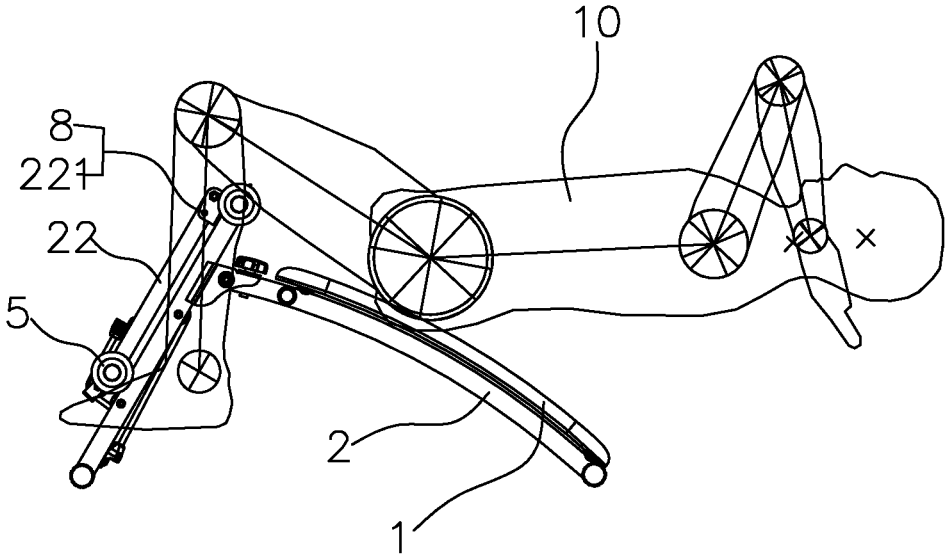
Figure 8:
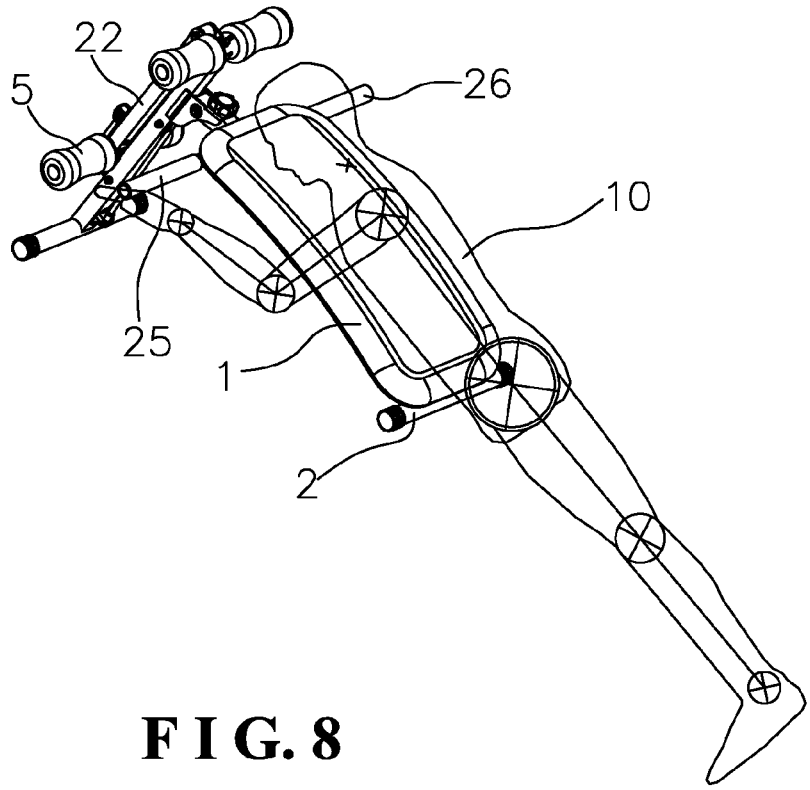

As shown in FIG. 7, the pin 8 is inserted in the pin hole 221 of the upper portion of the vertical support 2. The user 10 can hook the sponge pipe on the lower foot rest 5 with his/her feet and lie face up for doing sit-ups to get stronger abdominal muscles. As shown in FIG. 8, the user can hold a sponge pipe 26 on the armrest pipe 25 for doing push-ups.

Figure 4:
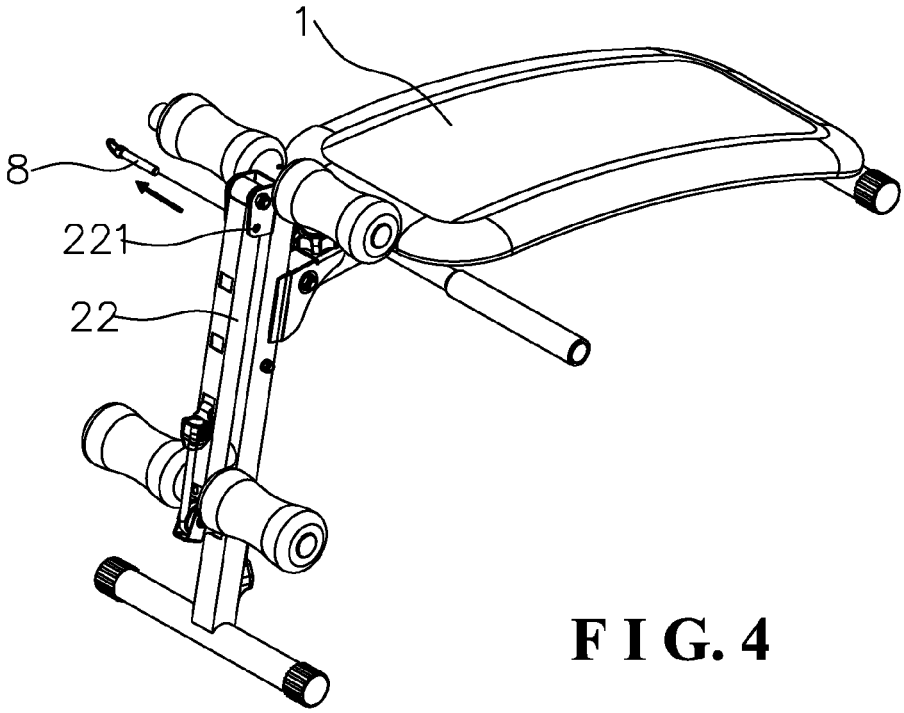
FIG. 4 is a schematic view showing the pin to be pulled out according to the preferred embodiment of the present invention.
Figure 5:
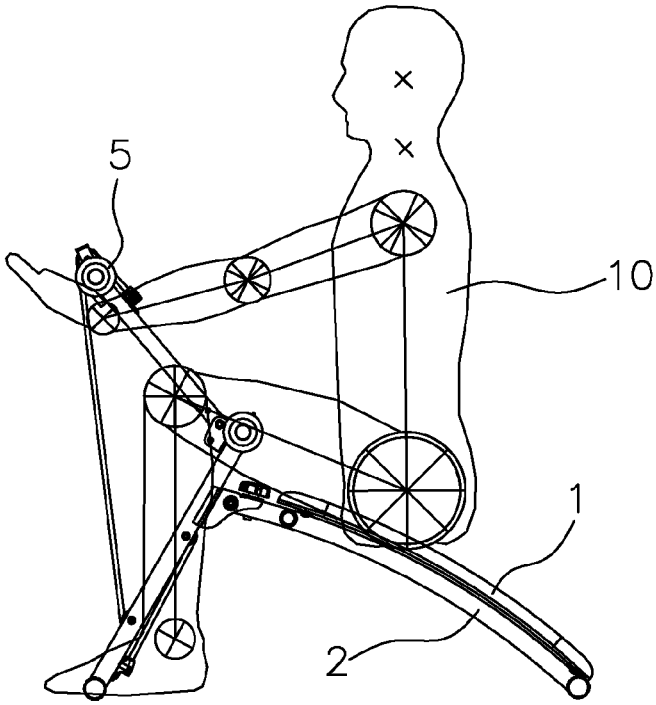
FIG. 5 through FIG. 9 are schematic views of the preferred embodiment of the present invention in different uses.
Figure 6:
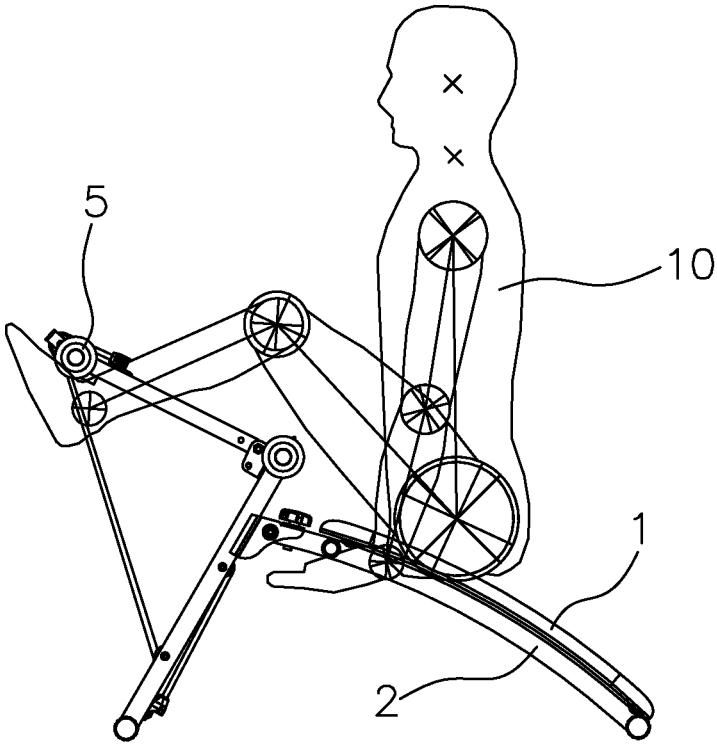
Figure 9:
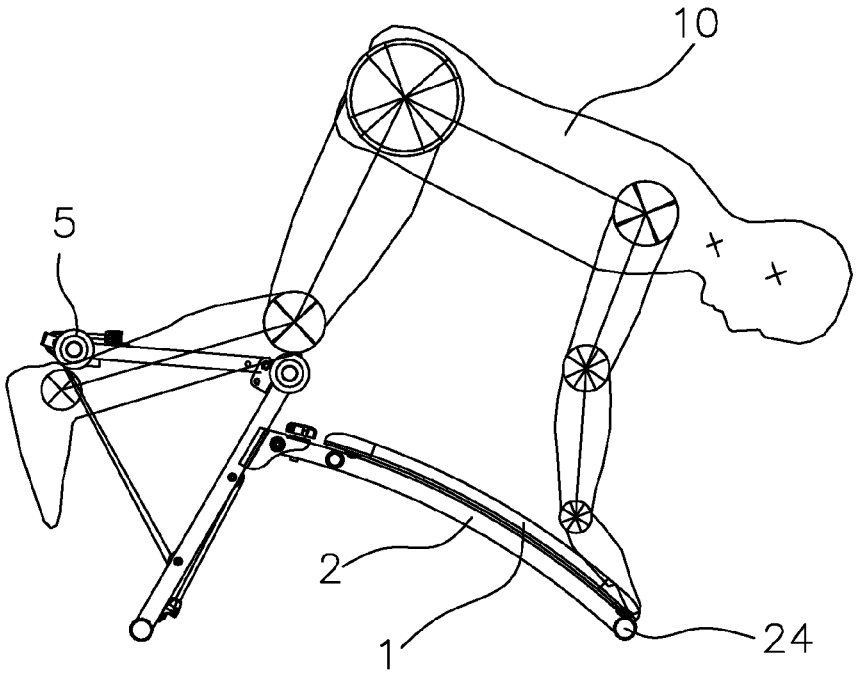

As shown in FIG. 4, the pin 8 can be pulled out from the pin hole 221 of the upper portion of the vertical support 22. The user holds the sponge pipe on the lower foot rest 5 for doing up and down exercise to get stronger arm muscles, as shown in FIG. 5. As shown in FIG. 6, the user can hook the sponge pipe on the lower foot rest 5 with his/her feet for doing up and down exercise. As shown in FIG. 9, the user holds the rear bottom bracket 24 with his/her hands, and hooks the sponge pipe on the lower foot rest 5 with one heel for doing up and down exercise, and then do the same exercise with another leg.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An exerciser, comprising a board, a frame, a swing rod, an upper foot rest, a lower foot rest and a resilient rope, with the frame comprising a lengthwise beam, a vertical support, a front bottom bracket and a rear bottom bracket, a front end of the lengthwise beam being perpendicularly fixed to a central portion of the vertical support and a rear end of the lengthwise beam being perpendicularly fixed to a central portion of the rear bottom bracket, an upper end of the vertical support being fixed to a central portion of the upper foot rest and a lower end of the vertical support being fixed to a central portion of the front bottom bracket, the lengthwise beam and the vertical support forming a triangular support, an upper end of the swing rod being articulated to an upper end of the vertical support and a lower end of the swing rod being fixed to a central portion of the lower foot rest, the resilient rope being connected between the swing rod and the vertical support, the board being fixed on the lengthwise beam of the frame, wherein an inner end of the resilient rope is fixed to a lower portion of the vertical support, a central portion of the resilient rope winds through a first pulley on an upper portion of the vertical support, a second pulley on the lower portion of the vertical support and a third pulley on the lower end of the swing rod, and an outer end of the resilient rope is connected to a central portion of the swing rod.

* * * * *